US010041758B2

(12) United States Patent
Papelard

(10) Patent No.: US 10,041,758 B2
(45) Date of Patent: Aug. 7, 2018

(54) ASSEMBLY FOR EJECTING THE CONTENTS OF A BOTTLE CONTAINING AN EFFERVESCENT LIQUID SUCH AS CHAMPAGNE AND A SEALING-DIFFUSING GASKET FOR SAID ASSEMBLY

(71) Applicant: EXTRANIGHT, Courthiézy (FR)

(72) Inventor: Frédéric Papelard, Essômes sur Marne (FR)

(73) Assignee: EXTRANIGHT, Courthiezy (FR)

( * ) Notice: Subject to any disclaimer, the term of this patent is extended or adjusted under 35 U.S.C. 154(b) by 0 days.

(21) Appl. No.: 15/567,580

(22) PCT Filed: Mar. 31, 2016

(86) PCT No.: PCT/EP2016/057074
§ 371 (c)(1),
(2) Date: Oct. 18, 2017

(87) PCT Pub. No.: WO2016/169742
PCT Pub. Date: Oct. 27, 2016

(65) Prior Publication Data

US 2018/0135936 A1 May 17, 2018

(30) Foreign Application Priority Data

Apr. 21, 2015 (FR) ..... 1553559

(51) Int. Cl.
*A63H 3/18* (2006.01)
*F41B 9/00* (2006.01)
(Continued)

(52) U.S. Cl.
CPC ..... *F41B 9/0075* (2013.01); *B65D 47/2031* (2013.01); *B67C 9/00* (2013.01)

(58) Field of Classification Search
CPC ..... F41B 9/0075; B67C 9/00; B65D 47/2031
(Continued)

(56) References Cited

U.S. PATENT DOCUMENTS 3,863,673 A * 2/1975 Sitton ..... B67C 9/00 137/170.2
2012/0018449 A1* 1/2012 Chia ..... A63H 23/10 222/79

FOREIGN PATENT DOCUMENTS

DE 9411980 U1 10/1994
DE 20116142 U1 1/2002
JP 2001241891 A 9/2001

OTHER PUBLICATIONS

No Author. "ZARB: Unconventional Sparkling Wine." Bollicine Divine, www.bollicinedivine.it/2011/01/zarb-unconventional-sparkling-wine/. Jan. 1, 2011. Retrieved for International Search Report Feb. 4, 2016. English translation of website retrieved Apr. 27, 2018. 8 pages.

(Continued)

*Primary Examiner* — Jeremy W Carroll
(74) *Attorney, Agent, or Firm* — Leason Ellis LLP

(57) ABSTRACT

The invention relates to an assembly (1) which includes a sealing-diffusing gasket (2) provided with a diffusion opening, intended for being clamped resiliently around the neck (5) of the bottle (3) and for sealing the mouth (7) of the bottle. The assembly also includes a fast portion (8) forming a hand grip, secured to the sealing-diffusing gasket (2), and including first hand-gripping means of the bottle (6) and first nesting means (8). The assembly also comprises a second portion (12) forming a hand grip and provided with second nesting means (12) suitable for nesting with the first nesting means (8) and second hand-gripping means (16) secured to the second nesting means (12). The assembly makes it possible to produce a jet of effervescent liquid of a selected (Continued)

size, duration and distance, by a user agitating the first and/or second hand grip portions (6 and 16) thus nested inside one another.

10 Claims, 3 Drawing Sheets

(51) Int. Cl.
*B67C 9/00* (2006.01)
*B65D 47/20* (2006.01)

(58) Field of Classification Search
USPC ..... 222/78, 79
See application file for complete search history.

(56) References Cited

OTHER PUBLICATIONS

International Search Report (Translation) for International Patent Application No. PCT/EP2016/057074 dated Jun. 27, 2016. 7 pages.

* cited by examiner

ASSEMBLY FOR EJECTING THE CONTENTS OF A BOTTLE CONTAINING AN EFFERVESCENT LIQUID SUCH AS CHAMPAGNE AND A SEALING-DIFFUSING GASKET FOR SAID ASSEMBLY

CROSS-REFERENCE TO RELATED PATENT APPLICATIONS

This application is a U.S. National Phase Application under 35 U.S.C. § 371 of International Patent Application No. PCT/EP2016/057074, filed Mar. 31, 2016, and claims the priority of FR 1553559, filed Apr. 21, 2015, all of which are incorporated by reference in their entireties. The International Application was published on Oct. 27, 2016 as International Publication No. WO 2016/169742 A1.

The present invention relates to an assembly for ejecting the contents of a bottle containing an effervescent liquid such as champagne and a sealing-diffusing gasket for the assembly.

It has general applicability in recreational accessories, and more particularly those associated with a jet of liquid such as champagne.

The playful "spraying" of guests with a shower or jet of champagne is traditionally part of the world of parties and celebration. This is usually done by partially sealing the mouth of an open bottle of champagne (or any other effervescent liquid) with the thumb so as to "pinch off" the area of the mouth that remains open so that, by shaking the bottle violently with both hands (more rarely with only one), the internal pressure of the bottle brings about the ejection of a jet of liquid whose length and width depend on the size and the shape of the area of the mouth that is uncovered as well as on the "shaking" force.

It was the object of the invention to provide a recreational accessory that reproduces the traditional spraying activity that is based on a bottle of champagne (or any other effervescent liquid) while taking on the shape and appearance of a firearm, such as a submachine gun, thereby rendering this spraying activity even more festive, safe, and fun.

The present invention provides just the solution to achieving this object.

It relates to an assembly for ejecting the contents of a bottle containing an effervescent liquid.

According to a general definition of the invention, the ejecting assembly comprises: a sealing-diffusing gasket provided with at least one diffusion opening and designed to be clamped resiliently around the neck of the bottle when the bottle is opened and placed into the ejection position and designed to seal the mouth of the bottle when the sealing-diffusing gasket is clamped in this way, and at least one first grip-forming part that is integrally formed with the sealing-diffusing gasket and comprises a first means for gripping the bottle in the hand when the bottle is in the ejection position, with the assembly enabling a jet of effervescent liquid to be produced which is of a selected size, duration, and distance when the first grip part is shaken by a user.

According to one embodiment, the first grip-forming part further comprises a first nesting means, and the assembly further comprises a second grip-forming part that is provided with a second nesting means that is designed to nest with the first nesting means when the bottle is placed in the ejection position, and a second gripping means that is integrally formed with the second nesting means, with the assembly enabling a jet of effervescent liquid to be produced which is of a selected size, duration, and distance when a user shakes the first and/or second gripping means that are nested in one another in this manner.

The ejecting assembly thus makes it possible to insert and securely hold a bottle while ensuring the tightness of the closure at the mouth and to eject liquid in a jet over a distance of several meters (5 m, for example) for a duration of several seconds (10 seconds, for example) and without endangering the user and the surrounding people.

According to one embodiment, the sealing-diffusing gasket is embodied as a single piece made of a flexible elastomer-type material.

In practice, the sealing-diffusing gasket comprises a mounting portion that is designed to be clamped resiliently around the neck of the bottle in the ejection position after the bottle is opened, and a sealing-diffusing portion designed to close the mouth of the bottle placed in the ejection position.

Alternatively, the gasket comprises a plurality of diffusion openings.

According to another embodiment, the first grip-forming part further comprises a clamping means for keeping the assembly of the sealing-diffusing gasket secure and sealed around the neck of the bottle in the ejection position.

According to yet another embodiment, the second grip-forming part further comprises a means for holding the body of the bottle in the ejection position.

In practice, the first nesting means comprises a tube having a selected length and diameter, whereas the second nesting means comprises a reinforcement rod that is shaped such that it mates with the tube in such a way that one nests in the other when the bottle is in the ejection position.

According to yet another embodiment, the first nesting means is integrally formed with the first gripping means, whereas the second nesting means is integrally formed with the second gripping means.

For example, the first and second gripping means are arranged in the shape of a gun grip.

The object of the present invention also includes a sealing-diffusing gasket that is suitable for the ejecting assembly according to the invention. According to another aspect of the invention, the gasket is capable of being clamped resiliently around the neck of the bottle in the ejection position after the bottle is opened and is capable of closing the mouth of the bottle placed in the ejection position, with the gasket being provided with at least one diffusion opening.

Other features and advantages of the invention will become apparent in light of the detailed description that follows and from the drawings, in which.

Figure 4A:
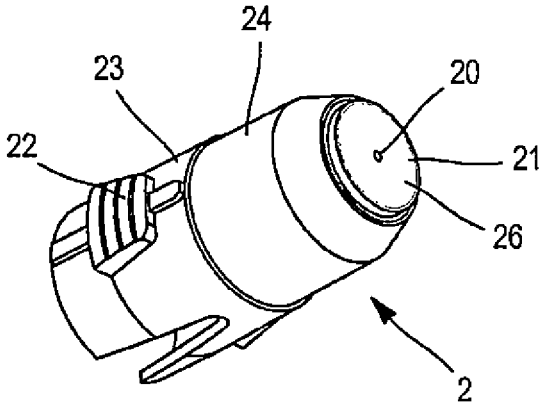
Figure 4B:
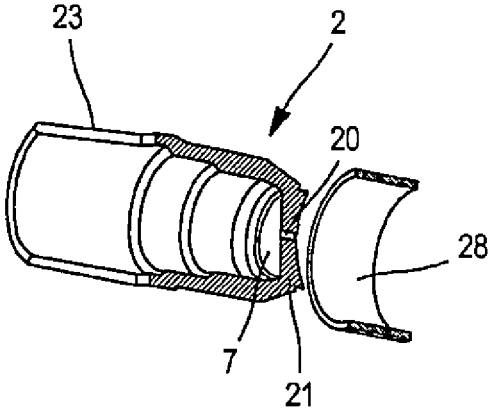
Figure 4C:
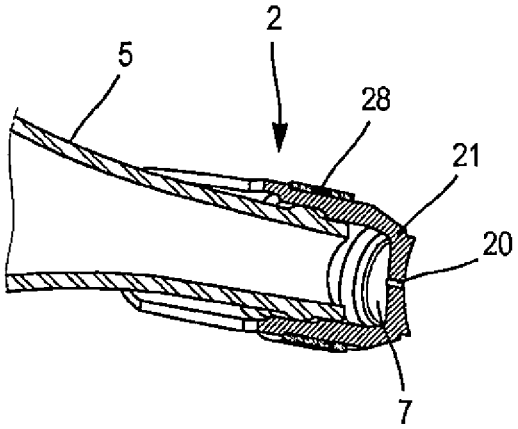
Figure 5:
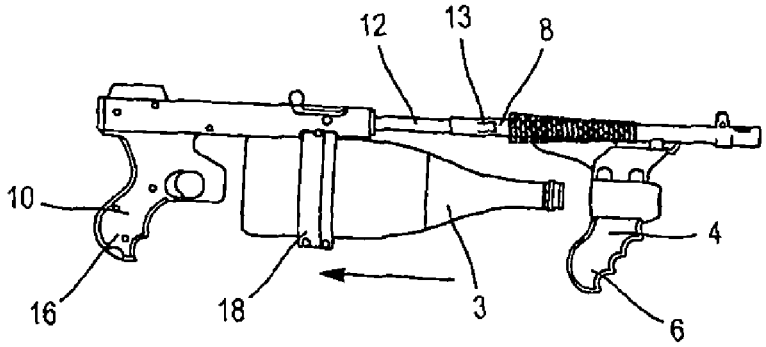
Figure 6:
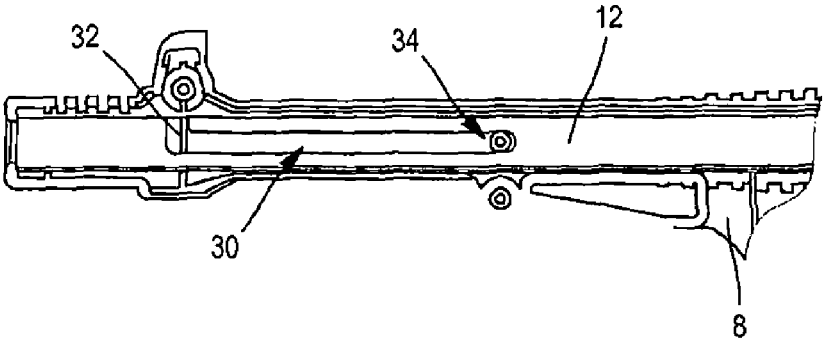
Figure 7:
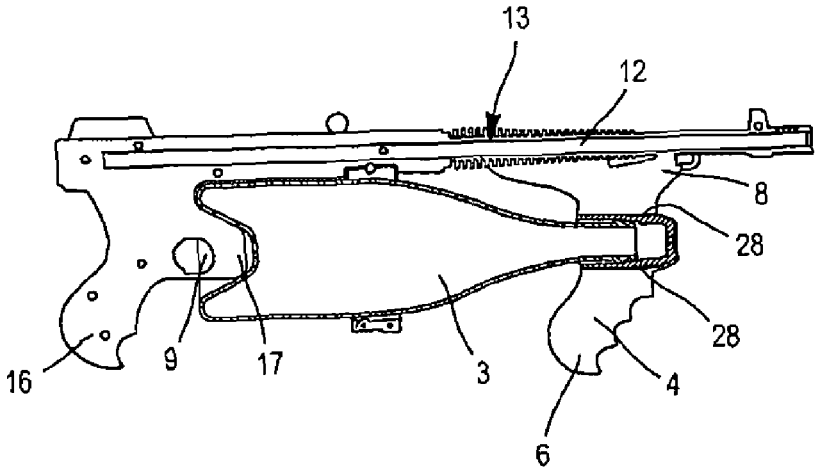

FIGS. 4A, 4B, and 4C show detailed views of the sealing-diffusing gasket according to the invention;

FIG. 5 shows the step of closing the ejecting assembly on the bottle;

FIG. 6 shows a schematic view of the nesting slides housed in the first grip part according to the invention; and FIG. 7 shows a sectional view of the ejecting assembly in the closed position.

Figure 1:
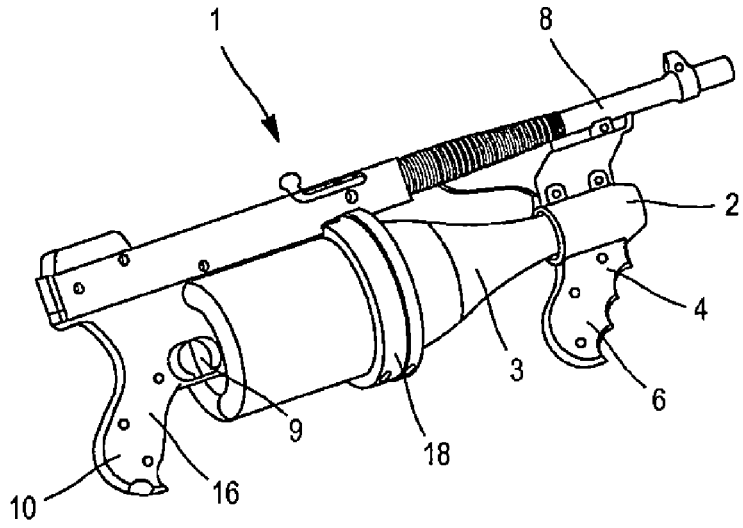
FIG. 1 shows a general, 3D view of the ejecting assembly in the closed position with a bottle in place.
Figure 2:
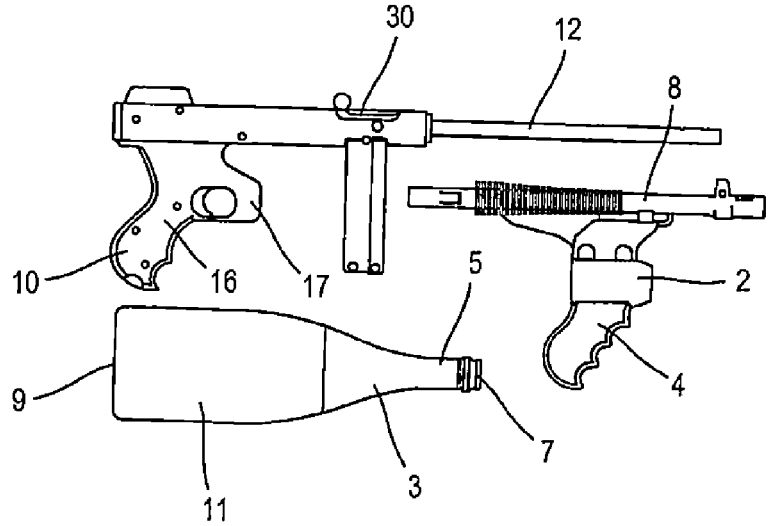
FIG. 2 shows an exploded view of the primary elements constituting the ejecting assembly according to the invention.
Figure 3:
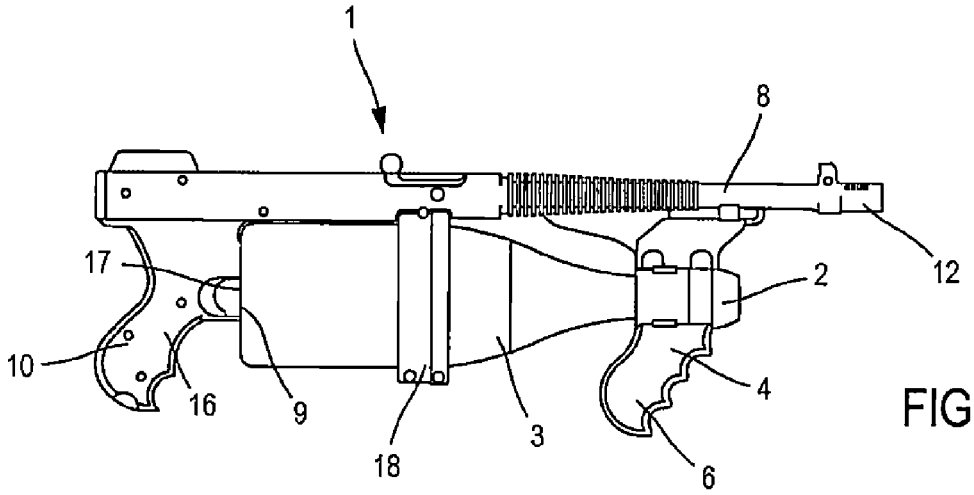
FIG. 3 shows a sectional view of the ejecting assembly in the closed position with a bottle in place.

With reference to FIGS. 1, 2, and 3, the ejecting assembly 1 comprises a sealing-diffusing gasket 2 and at least one first grip-forming part 4 that is integrally formed with the sealing-diffusing gasket 2 (one-handed mode). Advantageously, the ejecting assembly further comprises a second grip-forming part 10 which nests in the first grip-forming part 4 in the closed position when a bottle 3 is in place (two-handed mode).

The bottle 3 contains an effervescent liquid such as champagne. The capacity of the bottle 3 can be 25 cL; 33 cL; 37.5 cL; 75 cL; 150 cL, or more.

As will be described in greater detail below, the gasket 2 is suitable for being resiliently clamped around the neck 5 of a bottle 3 that is placed in the ejection position after the bottle is opened. The gasket 2 then closes the mouth 7 of the bottle 3 that is placed in this way in the ejection position.

The first grip-forming part 4 comprises a first means 6 (gun grip in front in the case of an assembly in the form of a submachine gun) for gripping the bottle that has been placed in the ejection position, and a first nesting means 8. The second grip-forming part 10 comprises a second nesting means (reinforcement tube) 12 that is capable of nesting in the closed position with the first nesting means 8 when the bottle is placed in the ejection position and a second gripping means 16 (gun grip in back) that is integrally formed with the second nesting means 12.

The assembly that has been mounted in this way in the closed position with the bottle placed in the ejection position (FIG. 1) enables a jet of effervescent liquid to be produced which is of a selected size, duration, and distance When in the form of a submachine gun having a center ring, the rear part of the assembly 1 is composed of a rear gun grip 16 having a center ring 18 for holding the bottle, and a reinforcement rod 12, whereas the front part of the assembly 1 is composed of a front gun grip and a barrel or hollow tube 8.

With reference to FIG. 3, the assembly 1 is in the closed position. The tube 12 enables the assembly 1 to be reinforced. For example, the rigid tube 12 is made of steel and can be hollow or solid. The bottle is held mechanically with the aid of the rear gun grip 16, which has a projection 17 having a shape which mates with the base 9 of the bottle.

With reference to FIGS. 4A, 4B, and 4C, the sealing-diffusing gasket 2 is embodied as a single piece. It is a centerpiece of the ejecting assembly. The gasket is preferably made of a flexible material so as to enable it to fit against and "hold" the neck 5 of the bottle at the moment it is closed. The trade-off between flexibility and rigidity in the material is also critical for controlling the deformation of the part when the pressurized liquid is ejected. In this regard, the structure at the gasket 2 can be reinforced with one or more holding parts (for example, clamping rings 28—FIGS. 4B and 4C) placed on or in the gasket as reinforcement in the areas of deformation.

For example, the gasket 2 is an elastomer that is kept under pressure on the neck 5 and the mouth 3. The jet of liquid must only emerge from the gasket through the opening 20 or openings 20 created on the front surface 21 of the gasket 2 facing toward the outlet of the mouth 7 of the bottle 3. The elastomer product is selected for its ability to adhere to the glass of the mouth that it is intended to seal. Protruding elements 22 can be arranged on the mounting portion 23 of the gasket 2 so as to facilitate the engagement of the gasket with the first grip part 4. These elements 22 can also be used to remove the gasket and exchange it for another type of gasket, for example in order to achieve a different jet configuration (wider jet of shorter duration or narrower jet of longer duration) or for a spout-type version.

The openings 20 on the front face (sealing portion) 21 of the gasket 2 enable the force and the direction of the liquid jet to be controlled. The distance and the general shape of the jet, as well as the duration of the activity, as well as the tightness at the mouth, depend on the configuration thereof (number, diameter, arrangement). For example, in "normal" usage conditions, in order to achieve a jet that exceeds 5 to 6 meters of distance while enabling the activity to last for a minimum of 15 seconds of continuous jet, a single opening 20 can be provided that has a diameter of less than or equal to 1.5 mm.

In one design variant, a shorter, wider, and more diffuse jet can be achieved by adding one or more holes 20 having a diameter that is less than or equal to that of the center hole and arranged around the periphery thereof.

With reference to FIG. 5, the first 4 and second parts 10 are in the nesting position with the rigid tube 12 inserted into the barrel (hollow tube) 8. The body 11 of the bottle 3 is inserted into the center holding ring 18. The bottle is opened (uncorked) beforehand. The ejecting assembly is closed by sliding the barrel 8 onto the steel reinforcement tube 12 until it reaches a holding clip 13 in the rear part 10 of the assembly. In the "clipped" position, the bottle 3 is held securely in the middle by the holding ring 18, at the bottom by the detent 17 on the fixture of the rear gun grip 16, and at the top in the diffusing gasket 2, which will seal the bottle 3 when the front barrel 12 is closed in order to hold the assembly.

With reference to FIGS. 6 and 7, a translational 30 and rotational slide system 32 is machined in the reinforcement tube 12. This enables the assembly to be opened and closed through the forward/rearward translation 30 of the front part 8 combined with a rotation 32 thereof, which enables the holding ring 18 to be disengaged completely from the rear part 10 so that the bottle can be inserted and to return to the closure axis once the bottle 3 is in place. A guide pin 34 is mounted on the inside face of the front part 12. The guide pin 34 travels along the slide 30 forward, rearward, and rotationally around the axis of the tube 12 when the front part is manipulated in order to open/close the ejecting assembly.

With reference to FIG. 7, the assembly 1 is in the closed position with a bottle 3 placed in the ejection position.

Such a "champagne submachine gun" is implemented in the following manner:

The assembly 1 is first opened by sliding the front part 8 on the tube 12 translationally toward the front until it reaches the detent 34 and then by pivoting it about the axis of the tube 12 over a sufficient angle (about 60 degrees). This translational/rotational movement enables the center holding ring 18 to be disengaged so that the previously opened bottle can be inserted therein in a vertical (or substantially vertical) position, mouth upward. Once the bottle is in place, it rests on the rear gun grip 16 and is held by the center ring 18. Closing is achieved by pivoting the front part 8 so as to return the front gun grip 6 to the axis of the rear gun grip 16. This position can be facilitated by means of foolproofing mechanisms (not shown) placed on the front 8 and rear parts 12 that only allow closure through the nesting of the two parts 12 and 8 once the alignment is correct. Once this alignment has been achieved, all that remains to be done is to slide the front part 8 rearward (or inward) from the reinforcement tube 12 until the front 8 and rear parts 12 nest completely. This complete closure can be realized by means of one or more reclosable clips 13, for example. Good closure thus means correct positioning of the diffusing gasket 2 on the mouth 7 of the bottle and the mechanical integrity of the assembly. After closure, the user initiates the activity by energetically shaking the assembly once or twice until the jet of liquid is formed, and he can continue by continuing to shake as necessary until the pressure inside the bottle is too low to maintain the jet of liquid satisfactorily.

In a variant, a provision can be made that the front part 8 of the assembly 1 is separate from the rear part 12. The previously opened bottle can then be inserted in a vertical position like in the previous case. Once the bottle is in place, closure is achieved by causing the front part 8 to engage on the reinforcement tube 12 of the rear part 12 and then aligning and reclosing the assembly as explained above.

In another variant of an embodiment of the invention, the disengagement from the holding ring 18 can be achieved by rotating the front part 8 outward about an axis that is perpendicular to the axis defined by the "barrel" part of the rear part 12 and situated at a junction between the front part 8 and the rear part 12. Once the bottle has been inserted as described previously, the assembly can be closed by pivoting the front part 8 in the opposite direction (inward) about the same axis until the front part 8 closes over the mouth 7 of the bottle 3.

The present invention is not limited to the embodiments described above but encompasses all of the embodiments that fall within the inventive concept thus described.

The invention claimed is:

1. An assembly (1) for ejecting the contents of a bottle (3) containing an effervescent liquid, characterized in that it comprises:

a sealing-diffusing gasket (2) provided with at least one diffusion opening and capable of being clamped resiliently around the neck (5) of the bottle (3) when the bottle is opened and placed in the ejection position and capable of sealing the mouth (7) of the bottle when the sealing-diffusing gasket is clamped in this manner, and at least one first grip-forming part (8) that is integrally formed with the sealing-diffusing gasket (2) and comprises a first means (6) for gripping the bottle when the bottle is in the ejection position, with the assembly enabling a jet of effervescent liquid to be produced which is of a selected size, duration, and distance through the shaking of the first grip part (6) by a user.

2. The assembly as set forth in claim 1, characterized in that the first grip-forming part further comprises a first nesting means (8), and the assembly further comprises a second grip-forming part (12) that is provided with a second nesting means (12) that is designed to nest with the first nesting means (8) when the bottle is placed in the ejection position, and a second gripping means (16) that is integrally formed with the second nesting means (12), with the assembly enabling a jet of effervescent liquid to be produced which is of a selected size, duration, and distance when a user shakes the first and/or second gripping means (6 and 16) that are nested in one another in this manner.

3. The assembly as set forth in claim 2, characterized in that the second grip-forming part further comprises a means (18) for holding the body of the bottle in the ejection position.

4. The assembly as set forth in claim 2, wherein the first nesting means comprises a tube (8) having a selected length and diameter, whereas the second nesting means comprises a reinforcement rod (12) that is shaped such that it mates with the tube in such a way that one nests in the other when the bottle is in the ejection position.

5. The assembly as set forth in claim 2, wherein the first and second gripping means (6 and 16) are arranged in the shape of a gun grip.

6. The assembly as set forth in claim 1, wherein the sealing-diffusing gasket (2) is embodied as a single part and made of a flexible elastomer-type material.

7. The assembly as set forth in claim 1, characterized in that the sealing-diffusing gasket (2) comprises a mounting portion (23) that is designed to be clamped resiliently around the neck of the bottle in the ejection position after the bottle is opened, and a sealing-diffusing portion (21) designed to close the mouth of the bottle placed in the ejection position.

8. The assembly as set forth in claim 1, wherein the gasket comprises a plurality of diffusion openings (20).

9. The assembly as set forth in claim 1, wherein the first grip-forming part further comprises a clamping means (28) for keeping the assembly of the sealing-diffusing gasket secure and sealed around the neck of the bottle in the ejection position.

10. A sealing-diffusing gasket (2) suitable for the ejecting assembly as set forth in claim 1, characterized in that the gasket is capable of being clamped resiliently around the neck (5) of the bottle in the ejection position after the bottle (3) is opened and is capable of closing the mouth (7) of the bottle placed in the ejection position, with the gasket (2) being provided with at least one diffusion opening (20).

* * * * *